US006573452B2

(12) United States Patent
Karlsson

(10) Patent No.: US 6,573,452 B2
(45) Date of Patent: Jun. 3, 2003

(54) TOOL FOR APPLICATION OF A STRAIN RELIEF

(76) Inventor: Per Karlsson, Grindtorpsvägen 21, Täby (SE), 183 32

( * ) Notice: Subject to any disclaimer, the term of this patent is extended or adjusted under 35 U.S.C. 154(b) by 0 days.

(21) Appl. No.: 09/986,960

(22) Filed: Nov. 13, 2001

(65) Prior Publication Data

US 2002/0056179 A1 May 16, 2002

Related U.S. Application Data

(62) Division of application No. 09/269,206, filed as application No. PCT/SE97/01617 on Sep. 25, 1997, now Pat. No. 6,326,546.

(51) Int. Cl.[7] ..... H01B 7/00
(52) U.S. Cl. ..... 174/70 R; 174/135
(58) Field of Search ..... 72/454, 409, 14, 72/416, 466.9; 174/70 B, 70 R, 135

(56) References Cited

U.S. PATENT DOCUMENTS

| | | | | | |
|---|---|---|---|---|---|
| 3,117,615 | A | * | 1/1964 | Graven | 251/8 |
| 3,982,060 | A | * | 9/1976 | Avery et al. | 174/75 |
| 4,096,627 | A | * | 6/1978 | Forney, Jr. et al. | 29/517 |
| 4,192,171 | A | * | 3/1980 | Hamilton | 29/517 |
| 4,292,833 | A | * | 10/1981 | Lapp | 72/409.01 |
| 4,365,499 | A | * | 12/1982 | Hirota et al. | 72/351 |
| 4,785,656 | A | * | 11/1988 | Kennedy | 29/237 |
| 5,083,943 | A | * | 1/1992 | Tarrant | 439/585 |
| 5,137,471 | A | * | 8/1992 | Verespej et al. | 439/585 |
| 5,166,997 | A | | 11/1992 | Norland et al. | 385/87 |
| 5,257,525 | A | * | 11/1993 | Clarke | 29/237 |
| 5,272,898 | A | * | 12/1993 | Dittlo et al. | 29/421.1 |
| 5,353,623 | A | * | 10/1994 | Bobenhausen | 29/237 |
| 5,465,599 | A | * | 11/1995 | Lee, Jr. | 72/125 |
| 5,559,917 | A | | 9/1996 | Ott | 385/86 |

FOREIGN PATENT DOCUMENTS

| | | |
|---|---|---|
| GB | 2 057 780 | 4/1981 |
| GB | 2 060 278 | 4/1981 |

* cited by examiner

*Primary Examiner*—Dean A. Reichard
*Assistant Examiner*—Jinhee Lee
(74) *Attorney, Agent, or Firm*—Jacobson Holman PLLC

(57) ABSTRACT

A tool for crimping a tubular crimp sleeve onto the end of a cable. The tool includes a frame structure, having two mutually opposing frame legs, which receives a crimping insert for a selected sleeve size. The insert includes two blocks that are brought together by means of a screw which, with the aid of a lever, is screwed through one of the frame legs so as to press the insert blocks together. A spring element strives to separate the two insert blocks, and at least one of the frame legs includes a recess for receiving the end of a corresponding one of the insert blocks.

9 Claims, 1 Drawing Sheet

TOOL FOR APPLICATION OF A STRAIN RELIEF

This application is a divisional application of U.S. Ser. No. 09/269,206 filed Mar. 31, 1999 now U.S. Pat. No. 6,326,546 which is the national phase under 35 USC §371 of PCT International Application No. PCT/SE97/01617 which has an International Filing Date of Sep. 25, 1997, which designated the United States of America and was published in English and claims priority from 9603614-0 filed Oct. 3, 1996 in Sweden which is claimed herein.

BACKGROUND OF THE INVENTION

1. Field of the Invention

The present invention relates to a cable strain relief of the kind having a plurality of conductors which are embraced by a cable casing and including a sleeve.

The invention also relates to a tool for fitting such a strain relief to a cable of corresponding diameter.

2. Description of the Related Art

The present invention relates to a cable strain relief of the kind defined in the preamble of claim 1.

The invention also relates to a tool for fitting such a strain relief to a cable in accordance with the preamble of the independent claim directed to the tool.

A strain relief is a connection element that is coupled to the circumference of a cable and enables forces that act in the length direction of the cable, i.e. axially acting forces, to be transferred to an external construction (e.g. a cable cabinet). Such a cable will normally include a bundle of individual, insulated conductors covered with screen braiding. An insulating sleeve is provided on top of the braiding.

Such strain reliefs will preferably be electromagnetically impervious, i.e. provide electromagnetic insulation (EMI), and must also be capable of transferring forces effectively, so as to prevent individual fibers from being subjected to tensile forces in junction boxes or the like.

A known type of strain relief intended for this purpose is comprised of two tubular parts that have co-acting, conical surfaces. One part (the inner part) has slits that extend axially from one end thereof, such as to form axially extending tongues. When the two parts are fitted together axially, the free ends of the tongues will be bent inwardly against the outside of the cable. The outer insulation is removed at the end of the cable and the braiding is folded back around the end of the remaining insulating sleeve. Consequently, when the two tubular parts are fitted together, parts of the braiding threads will be clamped between adjacent tongues. This often results in unsatisfactory anchoring of the strain relief to the cable.

Other known strain reliefs incorporate a U-shaped element whose legs are bent in towards the cable so as to overlap each other. This solution can result in damage to the individual conductors in the cable, and may also cause EMI-leakages to occur through the overlap.

Earlier known strain reliefs are expensive and require the use of complex devices for fitting the reliefs to cables, and also result in joints of greatly differing qualities.

SUMMARY OF THE INVENTION

Accordingly, the object of the invention is to provide a strain relief that can be fitted to cables of different standard diameters with the aid of a simple tool, such as to obtain an EMI-tight connection and a uniform result on each occasion.

Further objects of the invention will be evident from the following text, either directly or indirectly.

The invention is basically concerned with establishing a strain relief for a screened cable that includes a plurality of conductors, by crimping a crimp sleeve on that part of the cable at which the braiding has been folded back over said cable, said crimp sleeve incorporating means which function to achieve an EMI-tight coupling of the sleeve to the wall of an apparatus housing at the cable leadthrough or transit. Crimp sleeves of this kind are available in various diameters, lengths and wall thicknesses adapted to different cable diameters, so as to ensure that the crimp sleeve will be effectively anchored to the cable with the aid of a crimping tool and therewith provide an EMI-impervious cable connection.

In order to enable a generally uniform crimping force to be applied with sleeves of different diameters and different wall thicknesses, the larger crimp sleeves include a circumferential groove that reduces the crimping force required to achieve the requisite strain relief anchorage of the crimp sleeve to the cable.

The inventive crimping tool for crimping such strain relief sleeves may include a tool frame structure that has two generally parallel and mutually opposing frame members. Two opposing crimp inserts are placed between the frame members. The inserts include on their mutually facing sides recesses for crimping a sleeve of corresponding diameter on a corresponding cable. A screw meshes with a threaded hole through one frame member, so that the screw can be screwed in a direction towards the second frame member such as to bring the two inserts together. The inserts include means for guiding relative movement in said direction. The two inserts also include spring means which strive to move the inserts apart in said direction.

The two frame members have shallow recesses for receiving and localizing respective inserts. The tools can be used in conjunction with a set of insert pairs which each include crimping recesses that are adapted to crimp sleeves of correspondingly different sizes. In other respects, the insert pairs have generally equal outer dimensions in order to enable the insert pairs to be readily swapped in the frame structure. Owing to the relative guiding of the inserts and the spring means, the pair of inserts will be held automatically in the frame structure as soon as the inserts are inserted thereinto, and can readily be replaced manually with another pair of inserts, by first pressing the fitted pair of inserts together against the action of the spring means and then tipping the inserts out of one of the recesses and out of the frame structure. The recesses in the frame members are shallow recesses. The frame structure may conveniently have an elongated support arm and the screw may include a lever for facilitating rotation of the screw.

The invention will now be described in more detail with reference to an exemplifying embodiment thereof and also with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modification is within the spirit and scope of the invention will become apparent to those skilled in the art from this detailed description.

Figure 1:
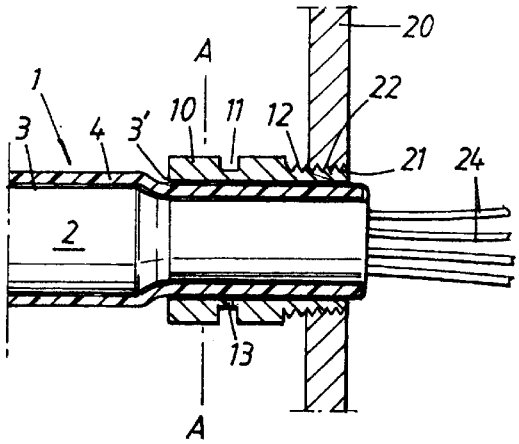
FIG. 1 shows an inventive strain relief fitted to the end of a cable and connected to the wall of an apparatus housing.
Figure 2:
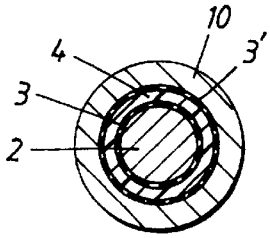
FIG. 2 is a cross-sectional view taken on the line A—A in FIG. 1 and images the strain relief prior to being crimped on the end of the cable.

FIGS. 1 and 2 illustrate a cable 1 comprising a core 2 that includes a plurality of insulated conductors 24, said core 2 being provided with screening braiding 3 which, in turn, is embraced by a cable casing 4. A length of casing 4 has been removed from the outermost end of the cable 1 and the braiding folded back over the remaining end part of the casing 4. A strain relief sleeve 10 is shown fitted over the backwardly folded screening part 3' of said end section. The front part of the sleeve 10 includes an externally threaded section 12 and also an outwardly open circumferential groove 11 between its ends. An opening 13 through the casing wall, for instance in the groove 11, enables it to be ascertained whether or not the screen 3' is located immediately beneath the sleeve 10. FIG. 1 also shows the wall 20 of an apparatus housing. The wall 20 includes an opening 21 having a thread that will mesh with the outer thread 12 on the sleeve. The sleeve 11 is anchored to the wall 20 by means of the screw joint 12, 22. The sleeve 10 lies in intimate contact with the screen 3, 3' around the whole of its circumference and tightly engages the wall 20 via the screw joint, so that the sleeve 10 will provide an EMI-tight connection to the apparatus housing (provided that the sleeve 10 and the wall 20 are made of a suitable material in this respect).

Figure 3:
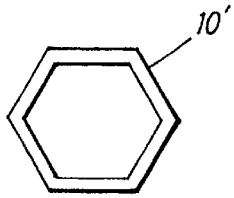
FIG. 3 illustrates the configuration of the strain relief subsequent to being crimped on the end of the cable.

The sleeve 10 is crimped onto the cable 1 so as to obtain an EMI-tight connection therewith. By crimping is meant that the sleeve 10 is subjected to plastic deformation from an essentially circular, round state into a polygonal shape, as illustrated in FIG. 3. Such crimping of the strain relief sleeve 10 provides a highly durable anchorage of the end of the cable 1 to the sleeve 10 with respect to tensile forces or strain acting in the length direction of the cable, while providing, at the same time, an EMI-tight connection between the sleeve 10 and the cable 1 and subjecting the insulated conductors 24 to stresses that are generally safe with respect to the integrity of the conductors 24.

The crimping technique requires a larger material thickness of the sleeve 10 in the case of large diameter cables 1 (with maintained crimping deformation pattern), which normally means that the crimping tool must exert crimping forces that increase markedly with increasing diameters of the cable 1 and the sleeve 10, by providing larger sleeves 10 with a circumferential groove 11 between its ends, and can limit the increase in requisite crimping forces that must be exerted by the crimping tool. This enables the use of a simple, and therewith cost favorable tool that includes exchangeable inserts that cover a whole series of differently sized sleeves 10 adapted to cables 1 of standard sizes.

Figure 4:
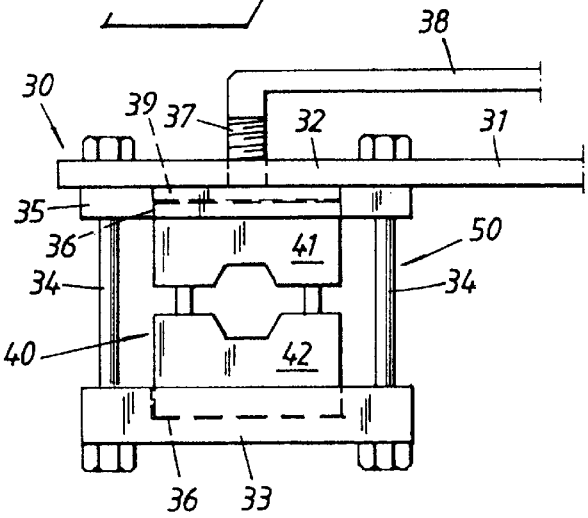
FIG. 4 shows a tool for crimping the strain relief sleeve.
Figure 5:
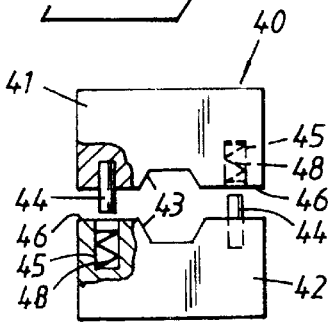
FIG. 5 is a sectional view of a crimping tool insert.

FIGS. 4 and 5 illustrate one such simple tool 30 with associated inserts 40.

The crimping insert 40 is comprised of two mutually co-acting blocks 41, 42, which may be mutually identical. Each of the blocks 41, 42 has an orthogonal parallelepipedic shape and each of the mutually opposing sides of the blocks includes a recess 43, said recesses together defining an hexagonal opening when the blocks 41, 42 are in mutual abutment. The hexagonal shape corresponds to the final external shape 10' (FIG. 3) of the crimped sleeve 10. Each block 41, 42 has a guide pin 44 on one side of the recess 43 and a corresponding aperture or hole 45 on the other side thereof. A helical spring 48 is placed on the bottom of each aperture 45. Each block 41, 42 is therewith designed so that the pin 44 of one block 41will fit into the hole 45 in the other block, and vice versa.

Although the blocks 41, 42 are mutually identical as a result of the illustrated construction of the insert 40, it will be obvious to the person skilled in this art that the blocks 41, 42 can be constructed differently with respect to the pins 44, the holes 45 and the springs 48, while retaining the function of the blocks. FIG. 4 illustrates a tool handle 31 which has at one end a frame structure 50 formed by the end-part 32 of the handle, a so-called yoke 33 which is carried by two bolts 34 that extend perpendicularly through the yoke 33 and through the handle part 32 and take up forces that strive to move the yoke 33 away from the handle part 32. The yoke has a recessed part 36 which receives an adjacent end of the block 42. A guide plate 35 is carried on the inside of the frame structure 50, parallel with the yoke 33. The guide plate has a recessed part 36 with a bottom plate 39 which is movable along the bolts 34 and which lies normal to the handle part 32.

When the blocks 41, 42 (FIG. 5) are pressed together so as to bring their adjacent surfaces 46 essentially into contact with one another, the insert 40 can be inserted laterally into the frame structure 50 in alignment with the recess 36, whereafter the insert 40 is allowed to expand under the action of the springs 48 to the state shown in FIG. 4, where the insert 40 is thus held by the expansion forces of the springs 48. The insert 40 can, nevertheless, be easily removed from the frame structure, by first compressing the insert and then tilting it out of the frame structure 50.

A series of inserts 40 that have essentially identical external dimensions but recesses 43 of mutually different sizes can be used in conjunction with the tool 30. These inserts 40 can be readily exchanged in the tool 30, which has an extremely simple construction as evident from the a foregoing.

When the crimp sleeve has been crimped firmly to the cable with a radial load that is distributed generally uniformly in the length direction of the sleeve, the sleeve will be deformed radially more pronouncedly at its ends (i.e. obtain a smaller diameter) than in its central region. This effect is apparently due to weakening of the sleeve wall by the centre groove 11. This results in the section of cable located in the sleeve between its ends being stretched axially to some extent, which could be detrimental to the conductors in the cable. Instead, the cable section is compressed in the crimp sleeve, wherewith inclination of the end-edges of the sleeve provides a particularly effective transfer of axial forces between the crimped sleeve and the cable.

It will be noted in particular that the crimped sleeve and the crimping force engage all conductors, conductor insulation, screens and the like in the cable, so that all cable parts will obtain an axial force-coupling to one another and to the crimped sleeve, such that said cable components will not experience any relative axial movement when axial forces are applied. Furthermore, the crimping affords radial compression of the cable, so that the cable will be sealed against axial fluid throughflows between the cable components. It will also be noted that the crimp sleeve is a single ring-shaped element, which facilitates work in fitting the sleeve.

Although the crimp sleeve is shown in FIG. 1 to be provided with an axial tubular extension having an outer thread, it will be understood that this extension can be omitted and a separate sleeve nut, or the like, that axially couples the sleeve to an externally threaded leadthrough sleeve on an apparatus housing, or the like, may be used instead.

The invention being thus described, it will be apparent that the same may be varied in many ways. Such variations are not. to be regarded as a departure -from the spirit and scope of the invention, and all such modifications as would be recognized by one skilled in the art are intended to be included within the scope of the following claims.

What is claimed is:

1. A tool for crimping a strain relief sleeve on a cable, comprising:

a frame structure having mutually opposing first and second frame legs which are substantially parallel to one another, at least one of said frame legs having a recessed portion on a surface facing the other frame leg;

a crimping insert for insertion between said first and second frame legs within said frame structure and including two mutually co-acting blocks and a spring mechanism acting to separate the two blocks, said blocks abutting one another along mutually opposing sides when said spring mechanism is compressed, each of said mutually opposing sides having a recess, said recesses together defining an hexagonal shape when the blocks are in mutual abutment, said recessed portion of said frame structure for receiving an end of one of said blocks securing said insert within said frame structure; and a screw which is screwed through said first frame leg for movement of said first frame leg in a linear direction toward said second frame leg so as to compress said spring mechanism and bring the blocks of said insert together into mutual abutment.

2. The tool as set forth in claim 1 wherein each of said blocks includes a guide pin on one side of said recess and a corresponding aperture on a second side of said recess such that, when said blocks are brought into mutual abutment, the guide pin of one of said blocks fits into the aperture of the other block, said spring mechanism being placed within one of said apertures.

3. The tool as set forth in claim 2, further comprising a second spring mechanism such that each of said apertures includes a respective one of said two spring mechanisms.

4. The tool as set forth in claim 1, wherein said recessed portion is provided in each of said first and second frame legs, each said recessed portion for receiving the end of a respective one of said blocks.

5. The tool as set forth in claim 1, wherein said first frame leg is comprised of an end part of a handle and said screw includes a generally radially extending lever, said screw co-acting with said first frame leg which is provided with a plate against which the screw acts, the plate being guided for movement in the frame structure.

6. The tool as set forth in claim 5, wherein the plate includes the recessed portion which receives the end of one of said blocks.

7. The tool as set forth in claim 1, wherein said frame legs are held in relationship with one another by two bolts which extend substantially perpendicularly from one frame leg to the other.

8. The tool as set forth in claim 7, wherein said first frame leg is comprised of an end part of a handle and said screw includes a generally radially extending lever, said screw co-acting with said first frame leg which is provided with a plate against which the screw acts, the plate being guided for movement in the frame structure along said bolts.

9. The tool as set forth in claim 1, said insert being laterally insertable and removable from said frame structure through compression of said spring mechanism, bringing said blocks into contact with one another, said spring mechanism upon insertion and alignment with said recessed portion exerting expansion forces to hold the insert in place.

* * * * *